US008171665B2

(12) United States Patent
Holzknecht et al.

(10) Patent No.: US 8,171,665 B2
(45) Date of Patent: May 8, 2012

(54) PORTABLE FIREARMS HAVING IDENTIFICATION MARKS

(75) Inventors: Dirk Holzknecht, Shramberg (DE); Ernst Mauch, Dunningen (DE); Michael Schumacher, Fluorn-Winzeln (DE)

(73) Assignee: Heckler & Koch, GmbH (DE)

( * ) Notice: Subject to any disclaimer, the term of this patent is extended or adjusted under 35 U.S.C. 154(b) by 1350 days.

(21) Appl. No.: 11/005,604

(22) Filed: Dec. 6, 2004

(65) Prior Publication Data

US 2005/0183314 A1 Aug. 25, 2005

Related U.S. Application Data

(63) Continuation of application No. 10/459,924, filed on Jun. 12, 2003, now abandoned, which is a continuation of application No. PCT/EP01/14599, filed on Dec. 4, 2001.

(30) Foreign Application Priority Data

Dec. 14, 2000 (DE) ..... 100 62 239

(51) Int. Cl.
*F41A 9/53* (2006.01)

(52) U.S. Cl. ..... 42/1.01; 42/70.01

(58) Field of Classification Search ..... 42/1.01, 42/70.01, 70.11

See application file for complete search history.

(56) References Cited

U.S. PATENT DOCUMENTS

| | | | |
|---|---|---|---|
| 3,453,892 | A | 7/1969 | Hudson |
| 3,785,261 | A | 1/1974 | Ganteaume |
| 3,914,996 | A | 10/1975 | Davis et al. |
| 4,488,370 | A | 12/1984 | Lemelson |
| 4,541,191 | A | 9/1985 | Morris et al. |
| 4,748,668 | A | 5/1988 | Shamir et al. |
| 5,033,217 | A | 7/1991 | Brennan |
| 5,097,253 | A | 3/1992 | Eschbach et al. |
| 5,189,395 | A | 2/1993 | Mitchell |
| 5,291,680 | A | 3/1994 | Schabdach et al. |
| 5,406,730 | A | 4/1995 | Sayre |
| 5,416,486 | A | 5/1995 | Koert et al. |
| 5,437,117 | A | 8/1995 | Mackey, III |
| 5,537,771 | A | 7/1996 | Martin |
| 5,566,486 | A | 10/1996 | Brinkley |
| 5,636,464 | A | 6/1997 | Ciluffo |
| 5,656,996 | A | 8/1997 | Houser |
| 5,700,088 | A | 12/1997 | Piacente et al. |
| 5,715,623 | A | 2/1998 | Mackey, III |

(Continued)

FOREIGN PATENT DOCUMENTS

| | | |
|---|---|---|
| DE | 3911804 | 10/1990 |

(Continued)

OTHER PUBLICATIONS

Small Arms of the World, W.H.B. Smith, p. 327.*

(Continued)

*Primary Examiner* — J. Woodrow Eldred

(74) *Attorney, Agent, or Firm* — Hanley, Flight & Zimmerman, LLC

(57) ABSTRACT

Portable firearms having identification marks and methods of making the same are disclosed. An example firearm includes a first identification number visibly located on the firearm; and a second, hidden or disguised identification number associated with the first identification number to facilitate identifying the firearm if the first identification number is destroyed, changed, or damaged.

21 Claims, 2 Drawing Sheets

U.S. PATENT DOCUMENTS

| | | | |
|---|---|---|---|
| 6,002,343 | A | 12/1999 | Auerbach et al. |
| 6,116,298 | A | 9/2000 | Haimovich et al. |
| 6,226,913 | B1 | 5/2001 | Haimovich et al. |

FOREIGN PATENT DOCUMENTS

| | | | |
|---|---|---|---|
| DE | 4022038 | A1 | 1/1992 |
| DE | OS 4433337 | | 3/1996 |
| DE | 19607294 | | 8/1997 |
| DE | 19707399 | | 8/1998 |
| DE | 19839622 | | 2/2000 |
| EP | 0955618 | A2 | 11/1999 |
| GB | 2182424 | | 5/1997 |
| GB | 2340589 | | 2/2000 |
| WO | 98/04880 | | 2/1998 |
| WO | 01/13217 | | 2/2001 |
| WO | 01/61268 | | 8/2001 |

OTHER PUBLICATIONS

Rivolier Company, catalogue No. 5, " Matériels & Equipements pour Forces de l'Ordre", *Equipol*, table of contents plus pp. 47-48 (1999) (4 pages).

Brandt and Reibert, *Der Dienstunterricht im Heere*, Verlag E. S. Mittler & Sohn GmbH, pp. 2-12 and 120-127 (1960).

English Translation of International Preliminary Examination Report for PCT/EP01/14599, Sep. 26, 2002.

International Search Report for PCT/EP01/14599, Mar. 3, 2002.

Hi-G-Tek brochure, Israel, "Electronic Armory" (no date).

* cited by examiner

PORTABLE FIREARMS HAVING IDENTIFICATION MARKS

RELATED APPLICATIONS

This patent arises from a continuation of U.S. patent application Ser. No. 10/459,924, which was filed Jun. 12, 2003 now abandoned, which is a continuation of international patent application serial number PCT/EP01/14599, which was filed on Dec. 4, 2001 and has a priority date of Dec. 12, 2001.

FIELD OF THE DISCLOSURE

This disclosure relates generally to firearms, and, more particularly, to portable firearms having first and second identification marks and methods of making the same.

BACKGROUND

It is known to stamp a unique weapon number into the frame or butt of a firearm for the purpose of tracking ownership and/or use of the weapon. Firearms are well known (see, for example, DE-OS 44 33 337) which, along with the usual stamped weapon number, include an electronic chip which also contains all the necessary information for uniquely identifying the weapon. In these known firearms, the chip is easily identifiable and can be removed, if desired, so that the weapon becomes indistinguishable from a weapon which never had a chip.

In most countries the identification numbers of handguns and other firearms are registered such that, if a lost weapon is found or if a weapon is used in a criminal act, its origin can be confidently ascertained by accessing a database associating weapon numbers with weapon owners. In this way it can be determined which authorized person (e.g., a weapons dealer, a soldier, a civilian) was the last authorized person to acquire the weapon. This information can be used to return a lost weapon to its rightful owner, or, in the case of criminal activity, to identify a person that mis-used a weapon. If the weapon was lost or stolen, this fact would ordinarily be on record.

For registration purposes every weapon is assigned a unique weapon or identification number as mentioned earlier. The weapon or registration number is typically a unique identification code consisting of numbers and/or letters which is stamped into the main part of the firearm. For example, the identification number may be stamped into the butt of an automatic pistol. Identification numbers are equivalently referred to herein as "number," "registration number," "weapon number," "serial number," and "identification number." In most countries, even weapons which, for whatever reason, were manufactured with no number, are required to be subsequently stamped with a recorded identification number uniquely identifying the weapon.

If the butt of a firearm is made of metal, the registration number is usually stamped a considerable depth into the butt, so that the simple filing down of the number does not prevent it from being restored and read later. However, if the corresponding section of the butt is cut out or stamped over multiple times with similar stamped letters, reproduction of the number may be rendered impossible, or at least made very difficult.

If the handle of a firearm is made of plastic, a metal plate bearing a registration number may be embedded into the handle. This plate can typically, however, be milled out without rendering the weapon useless such that at least a few shots can still be fired.

To at least render it difficult to prevent the identification of a weapon, it is well known to stamp at least parts of the identification number in multiple (or even all) possible parts of the weapon. However, this measure originally served the purpose of avoiding accidental interchange of the individual parts of two or more weapons during, for example, the cleaning of military weapons.

A small number of authorized persons illegally pass on their weapons to unauthorized persons. If such a weapon is found, its authorized person can be easily traced on the basis of the identification number, provided this has not been made impossible by means of removing the number or rendering it illegible.

While it is true that using electronic identification codes or devices in weapons is already well known (see, for example, WO 98/04880, DE 40 22 038 and DE 39 11 804), the presence of these devices in a firearm are not disguised or otherwise hidden and, thus, these devices are subject to frustration through tampering and/or removal.

DETAILED DESCRIPTION

Figure 1:
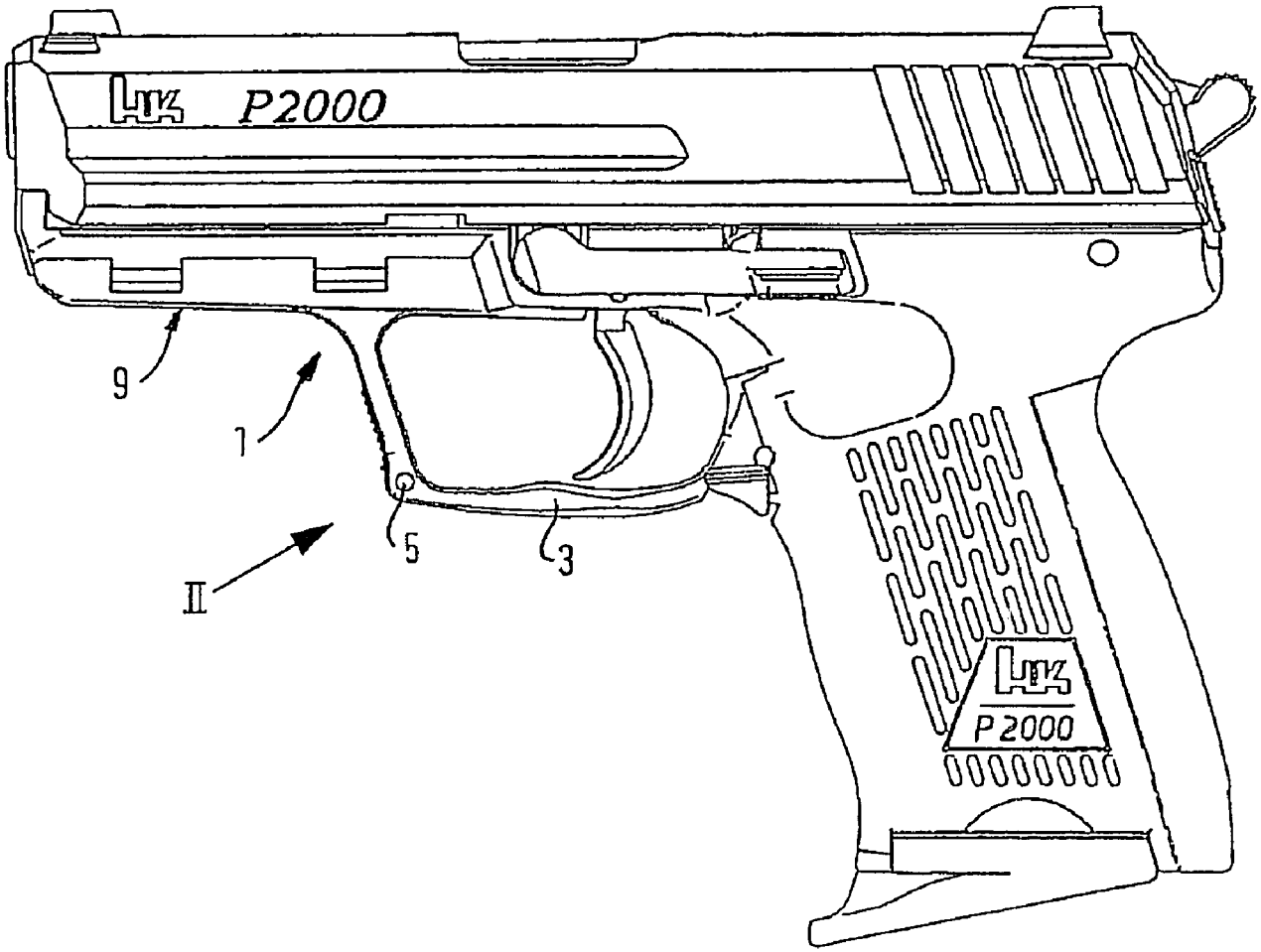
FIG. 1 is a side view of an example automatic firearm constructed in accordance with the teachings of the invention.

FIG. 1 is a side view of an example automatic handgun. The example handgun of FIG. 1 includes a housing 1, which is made predominantly of plastic and onto which a trigger guard 3 is molded in one piece.

To give the hand that is not holding the handle of the pistol during shooting and which additionally supports the pistol in the beginning a reliable contact surface, the trigger guard 3 has a front handle surface. Since this contact surface runs in a generally straight line and protrudes to the front on the underside of the weapon, the trigger guard 3 has a bulge in front and at the bottom to prevent slippage during handling or firing, as is recognizable with other pistols of this type. This bulge protrudes out from the surface of the weapon that is visible in FIG. 1.

Figure 2:
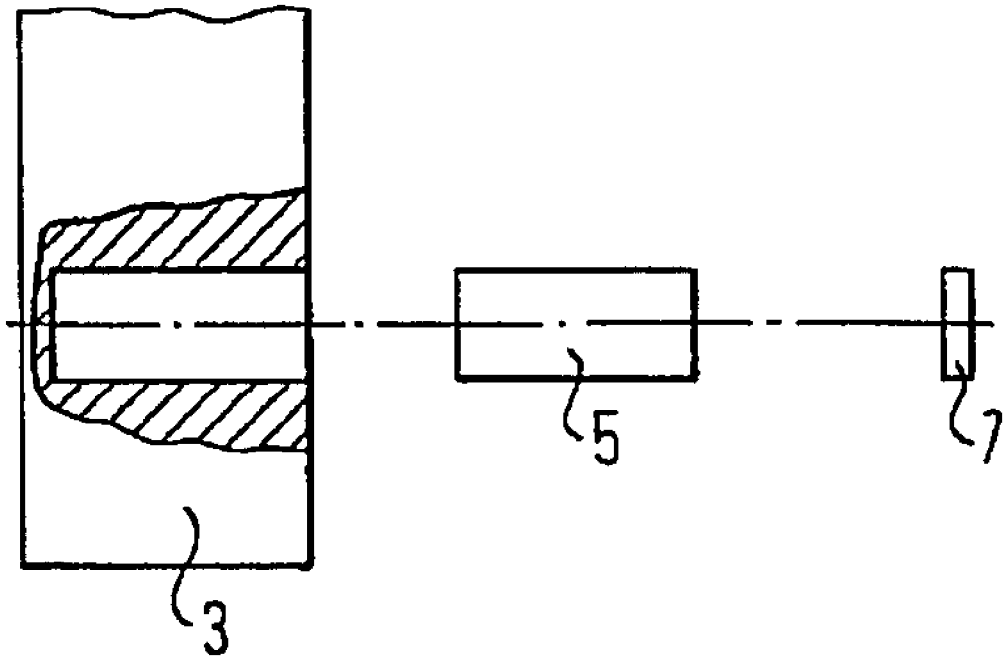
FIG. 2 is a partial cross-sectional view of the firearm of FIG. 1 taken from direction II in FIG. 1.

In the illustrated example, a pocket or cross-bore is located in this bulge. A small transponder 5 is seated in this cross-bore as shown in FIG. 2. Preferably the transponder 5 is cemented in this cross-bore. A lid 7 is seated above the transponder 5. The lid 7 terminates flush with the external surface of the trigger guard 3.

The illustrated pistol, (e.g., its muzzle, butt, and/or housing 1), includes an ordinary, openly visible, serial number 9. This serial number 9 is visible from below and is stamped onto a metal plate (not shown), which is poured or set into the plastic material of the housing. To facilitate viewing of the serial number 9, this metal plate is exposed at the bottom of the housing 1 and, thus, may be ground down from below using a grinding tool similar to an end mill mounted in a milling machine to the point that the serial number is completely removed and also can no longer be reconstructed.

If the serial number 9 is removed, the housing 1 is held with its trigger guard 3 in a scanning device (not shown), which gathers the information that is stored on the transponder 5. This information was already scanned at the factory during the production of the weapon and stored in association with the corresponding serial number 9. The obliterated serial number 9 can therefore be obtained at any time, even if it has been removed without a trace and/or with no hope of physical reconstruction.

The transponder 5 is preferably located in a place that is as far as possible from the metal parts of the weapon, such that scanning can take place undisturbed. However, this is not necessary, and it is also definitely possible to place the transponder 5 in any other area (e.g., preferably in areas that cannot be easily removed). Locating the transponder 5 in the trigger guard 3 has a disadvantage in that the trigger guard 3 can be easily sawed off should the presence of the transponder 5 in that structure become known.

From the foregoing, persons of ordinary skill in the art will appreciate that a portable firearm has been provided which may always be uniquely identified, even if efforts have been undertaken to make the physical serial number stamped on the weapon illegible.

There is basically no possibility of completely avoiding the removal, stamping over or obliterating of a physical serial number or the removal or erasure of an undisguised chip, as mentioned earlier. For this reason, the illustrated firearm includes a second, unique identification number which is independent of the first identification number. The second identification number is attached to the weapon, but hidden in a secret place, whose existence is preferably unknown to the dealer and the customer. Indeed, the existence of this secret place is preferably known only to the manufacturer and, if necessary, to the governmental authorities responsible for law enforcement. Alternatively, the second identification number may comprise seemingly harmless elements which are not identifiable as identification media.

Preferably, the manufacturer only makes it known that he is able to identify a weapon even when its number has been removed, mutilated or made illegible. The manufacturer keeps secret the manner in which this identification occurs. If a weapon is sent to the manufacturer by a court or police authority, then the manufacturer determines the secret identification number and can, identify the owner of the weapon on the basis of the manufacturer records. The weapon is then sent back to the authorities and they are simultaneously informed of the original number, which may or may not be identical to the secret identification number. The secret second identification number can remain where it is in the weapon.

The impression results that the first, generally visible and illegally removed number has been made legible again by means of a special method. The fact that the identification was made on the basis of a secret, second code is not obvious. The criminal will, thus, make an effort to remove the visible number as thoroughly as possible, but will not search for a second identification. For this reason, it is not necessary to hide the second identification number with special care, but rather it is sufficient to keep the normal user from finding out about it.

Preferably, the second identification number contains information from which the original serial number which is physically attached to the weapon can be derived.

This second identification number may be arranged in a hidden place, for example in the magazine box. Alternatively, this second identification number may not be recognizable as an identification number. For example, the second identification number may be implemented as a bar code in the recesses for holding and operating the hammer, or as omissions of fields in the checkering of the firearm stock. At least in the latter case, a user can see the second identification number without realizing that it is a unique identification of the weapon.

Placing the identification number at a hidden site of the weapon involves all kinds of difficulties. For this reason it is preferred that the second identification number is located on an identification medium that can be manufactured outside of the weapon (even at a separate company). After the identification medium is provided with the second identification number, it is then attached to or in the weapon, (preferably, to or in the butt or the housing), whereby the attachment is considerably simplified. The identification medium can be provided in such a way that the identification is not visible from the outside and/or is not recognizable without assistance. The identification medium can optionally be separated from the firearm for scanning (if an the medium is electronic) and/or reading of the second identification number.

However, it can also be of advantage to have the identification medium hidden by a lid that protects the identification medium from detection, removal, and/or inadvertent or intentional damage. This lid may optionally be removed to read the second identification number. The lid also protects the identification medium from outside influences; particularly from gun oil, which could damage or even disintegrate it.

To better prevent the discovery of the second (e.g., hidden and/or disguised) identification medium, the second identification medium may be attached in the interior of the weapon (e.g., in its housing or butt). Preferably, a recess or bore is defined in the weapon housing to receive the identification medium. This recess or bore is preferably closed by the inserted identification medium itself or by the above-mentioned lid in such a way that it cannot be recognized that an identification medium is hidden in this place. This recess is preferably attached to a massive area of the housing (e.g., the butt) and only open to one side, so that the inserted identification medium cannot be recognized when it is covered by a lid, paint or its own surface, even upon an attentive examination of the weapon.

The second (e.g., hidden) identification medium can be quite small, so that the weapon housing (e.g., the butt) offers countless opportunities to accommodate the second identification medium. The recess or bore, can be designed as a through recess or through hole, or a blind hole. In the case of a through hole, the hole may be provided on both sides with a lid or similar camouflage, so that the second identification medium can be easily pushed out of the recess or hole for reading and/or replacement when desired.

Preferably the second identification medium is embedded in the plastic of a plastic housing of the firearm. The second identification medium may be cemented in place in a recess. If the identification medium forms a projection, it may give the impression of a reinforcement or some other important functional part of the housing (e.g., the butt) and will, with great certainty, not be removed by a criminal, since this person will view the identification medium as being essential for the function of the weapon, particularly for the fatigue strength of the housing.

The second identification medium can be an engraved metal plate that must be removed to be read. However, the second identification medium is preferably designed as an electronic chip; even more preferably, as a transponder. In the case of the identification medium being implemented by a chip such as a transponder, it should not have its own power supply. On the contrary, the chip and/or transponder should be inductively energized and supplied with power by the scanner during the scanning process. Preferably, the chip and/or transponder can be scanned at a distance, but at the same time the chip and/or the transponder preferably has very small dimensions and can store considerable amounts of information. In such circumstances, the chip and/or transponder can be embedded in its entirety in a plastic housing (e.g., a butt or muzzle), even while it is scanned.

The scanner may receive the firearm housing in its entirety or may only receive a portion thereof (e.g., the butt) during a reading operation to thereby hide the precise location of the second identification medium from the person operating the scanner. The scanner may also have several sensors or antennae, and it does not have to be recognizable which of the sensors or antennae are excited/energized with queries, again to hide the precise location of the second identification medium from the person operating the scanner. Thus, even during a reading or scanning operation, it may not be detectable where in the firearm the chip or transponder is located. Consequently, it is possible to supply the authorities with scanners by means of which portable firearms incorporating the second hidden identification number can be examined to determine the second identification number without revealing the location of the second identification medium, because the scanners may be constructed to not provide any inference as to the area of the weapon in which the chip or transponder is seated.

It is also conceivable to inject a chip, transponder or other readable identification medium into the weapon housing (e.g., the butt or muzzle) during its production; provided this ID medium is sufficiently temperature-resistant so as to not be damaged by the cooling material housing the same.

In the preferred example shown in the drawings, the transponder is cylindrical or angular and sits in the housing. It could, for example, be seated in a pocket or blind bore. Such a pocket bore can be inserted into the housing with the simplest of resources. When the transponder is seated in the bore, the pocket bore is closed/sealed by the transponder itself or by a plug such that the transponder is no longer recognizable as such. Any remaining visible traces may just as well be the traces of a mold plug.

Since the transponders are preferably quite small, a bore with approximately 2.5 mm diameter and 10 mm length is sufficient. Such a bore can be placed in quite a few areas of an existing firearm housing. If a housing is specially created to hide the transponder, further options for the accommodation of the transponder can be created.

It is possible to synchronize the second (e.g., secret) identification number to the first (e.g., visible identification number), so that the first and second identification numbers are identical. However, this is often very difficult to achieve and would moreover break the links in the chain of secrecy, since in this way more persons would come into contact with the secret identification than are absolutely necessary. Accordingly, the two identification numbers are preferably different. For example, preprogrammed transponders are preferably supplied and inserted into the weapons with little effort. Then the transponders are scanned by means of a scanning device and assigned the stamped number of the weapon in a list or database. However, the scanning device can, as already noted above, be designed in such a way that it is not possible to infer the location of the transponder from it. Therefore, particularly if multiple possible locations are present in the firearm housing, the person scanning the firearms to create the database associating the first and second identification may not even be aware of the location of the transponder.

From the foregoing, persons of ordinary skill in the art will also appreciate that a method for manufacturing a portable firearm as described earlier has been disclosed. For example, a preprogrammed, cylindrical transponder is placed in a suitable recess of a firearm housing. The firearm housing is provided with a first identification number. The second identification number is then read from the transponder via a scanning device and stored in a list or database in association with the first identification number. This example method has the advantage that the best possible secrecy is guaranteed, so that no information about the location of the second identification number reaches the outside from the company. The public, including the authorities, only needs to know that the manufacturer is even able to read completely removed numbers. Outsiders do not need to be aware of the fact that this happens in a roundabout way via the secret second "number".

The transponder inserted into the recess, for example a pocket bore, is preferably covered by a lid or paint or poured or injected at the beginning. Then, if the bore or recess that receives the transponder is exposed to an outer surface, regular or additional surface finishing of the housing can be performed, so that the recess or bore is undetectably hidden. An example firearm is consequently created that has, in addition to the normal visible serial number, a transponder or chip in a hidden location with identifying information which is associated with the visible serial number. Since the public is unaware that such a transponder or chip exists, and since it is not visible, it will in all probability remain undetected, even if the visible serial number of the weapon is removed or rendered unrecognizable. As a result, the serial number can be reconstructed at any time.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A firearm, comprising:

a housing having a trigger guard;

a first identification number visibly located on the firearm and being a serial number stipulated for registration of the firearm; and a second identification number being a unique identification independent of the first identification number and being located on an identification medium, wherein the second identification number contains information from which the first identification number can be derived.

2. The firearm according to claim 1, wherein the identification medium is arranged in a recess located in the bulge of the trigger guard.

3. The firearm according to claim 2, wherein the recess formed in the trigger guard is a pocket, a through hole, or a blind hole, and the identification medium is seated in the recess.

4. The firearm according to claim 2, wherein the identification medium is cemented into the recess.

5. The firearm according to claim 2, wherein the recess is closed by the identification medium itself.

6. The firearm according to claim 2, wherein the recess having the identification medium arranged therein is closed by at least one lid.

7. The firearm according to claim 2, wherein at least one lid terminates flush with an external surface of the trigger guard.

8. The firearm according to claim 1, wherein the identification medium is a transponder.

9. The firearm according to claim 1, wherein the identification medium is adapted for at least one of being manufactured outside the firearm and being provided with the second identification number before arrangement in the recess of the trigger guard.

10. The firearm according to claim 1, wherein the identification medium is arranged for separation from the firearm.

11. The firearm according to claim 1, wherein the first identification number and the second identification number are different.

12. The firearm according to claim 1, wherein the identification medium is arranged in a recess located in a bulge in a front and at a bottom of the trigger guard.

13. A method of manufacturing a firearm, comprising the steps of:

providing a first identification number being a serial number stipulated for registration of the firearm;

locating the first identification number visibly on the firearm;

providing a second identification number being a unique identification independent of the first identification number and containing information from which the first identification number can be derived;

locating the second identification number on an identification medium; and arranging the identification medium having the second identification number thereon in a recess located in a bulge in a front and at a bottom of a trigger guard of the firearm.

14. A method according to claim 13, comprising the step of forming the recess in the trigger guard of the firearm in form of a pocket, a through hole and a blind hole.

15. The method according to claim 13, comprising the step of cementing the identification medium into the recess.

16. The method according to claim 13, comprising the step of arranging at least one lid above the identification medium being arranged in the recess.

17. The method according to claim 16, comprising the step of arranging the at least one lid such that the at least one lid terminates flush with an external surface of the trigger guard.

18. The method according to claim 13, comprising the step of providing a transponder as the identification medium.

19. The method according to claim 13, comprising the step of providing the identification medium with the second identification number before the step of arranging the identification medium in the recess.

20. The method according to claim 13, comprising the step of separating the identification medium from the firearm.

21. The method according to claim 20, comprising at least one of the steps of scanning and reading the second identification number from the identification medium being separated from the firearm.

* * * * *